United States Patent [19]

Kaspar et al.

[11] Patent Number: 5,036,966

[45] Date of Patent: Aug. 6, 1991

[54] NEWSPAPER VENDING RACK COIN BOX INCORPORATING A RETROFIT ELECTRONIC COIN MECHANISM

[75] Inventors: Douglas D. Kaspar; David C. Kaspar; Ralph Ullmann, all of Shiner, Tex.

[73] Assignee: Kaspar Wire Works, Inc., Shiner, Tex.

[21] Appl. No.: 364,230

[22] Filed: Jun. 12, 1989

[51] Int. Cl.[5] ..... G07F 5/16; G07F 11/04

[52] U.S. Cl. ..... 194/217; 194/239; 194/346; 194/351

[58] Field of Search ..... 194/215, 216, 217, 218, 194/219, 223, 224, 239, 240, 244, 343, 346, 351

[56] References Cited

U.S. PATENT DOCUMENTS

| | | | |
|---|---|---|---|
| 3,738,466 | 6/1973 | Knickerbocker . | |
| 3,786,421 | 1/1974 | Wostl et al. . | |
| 3,882,984 | 5/1975 | Knickerbocker . | |
| 3,894,220 | 7/1975 | Levasseur . | |
| 3,931,497 | 1/1976 | Gentile et al. . | |
| 3,946,848 | 3/1976 | Knickerbocker . | |
| 4,000,799 | 1/1977 | Knickerbocker . | |
| 4,037,701 | 7/1977 | Knickerbocker . | |
| 4,072,930 | 2/1978 | Luccro et al. . | |
| 4,075,463 | 2/1978 | Yurramendi et al. . | |
| 4,075,561 | 2/1978 | Stevens . | |
| 4,086,434 | 4/1978 | Bocchi . | |
| 4,216,461 | 8/1978 | Werth et al. . | |
| 4,231,105 | 10/1980 | Schuller et al. . | |
| 4,272,757 | 6/1981 | McLaughlin et al. . | |
| 4,306,219 | 12/1981 | Main et al. . | |
| 4,338,601 | 7/1982 | Nance-Kivell . | |
| 4,354,613 | 10/1982 | Desai et al. | 221/4 |
| 4,369,442 | 1/1983 | Werth et al. . | |
| 4,386,691 | 6/1983 | Voegeli | 194/220 |
| 4,412,292 | 10/1983 | Sedam et al. . | |
| 4,454,414 | 6/1984 | Benton . | |
| 4,512,453 | 4/1985 | Schuller et al. . | |
| 4,523,285 | 6/1985 | Hendrickson et al. . | |
| 4,611,205 | 9/1986 | Eglise . | |
| 4,630,624 | 12/1986 | Turner | 194/346 |
| 4,639,875 | 1/1987 | Abraham . | |
| 4,654,513 | 3/1987 | Hennessy | 221/194 X |
| 4,845,484 | 7/1989 | Ellsberg . | |
| 4,848,556 | 7/1989 | Shah et al. | 194/350 X |

OTHER PUBLICATIONS

Sho-Rack TK-MECH Coin Mechanism Service Manual by Kaspar Wire Works, Inc., Jan. 1, 1989.

*Primary Examiner*—F. J. Bartuska

*Attorney, Agent, or Firm*—Gunn, Lee & Miller

[57] ABSTRACT

This disclosure is directed to a retrofit coin measuring apparatus installed in a newspaper vending rack, and more particularly a retrofit structure which is electronically actuated. It incorporates a switch which is operated by insertion of a coin into the coin chute, switching on electrical power which is otherwise switched off to preserve battery life. The coin measuring apparatus has a removable retrofit structure which is attached by a lock bar. Inside the coin measuring apparatus, there is a switch which initiates operation of the electronic circuitry to test for bogus coins, to measure the value of the coin, and sum the total value of coins inserted until a price has been paid and to thereafter operate a door mounted on a paper receiving cabinet. The door is provided with a door hook cooperative with a door hook closure device to close and latch after the sale of a paper. After each sale, the electronic circuitry is switched off and is in a dormant state until the next transaction. It has a circuit recording the time and day of the sale, and such information is held in memory subject to retrieval by an infrared coupling for transfer elsewhere for analysis.

13 Claims, 6 Drawing Sheets

FIG. 1
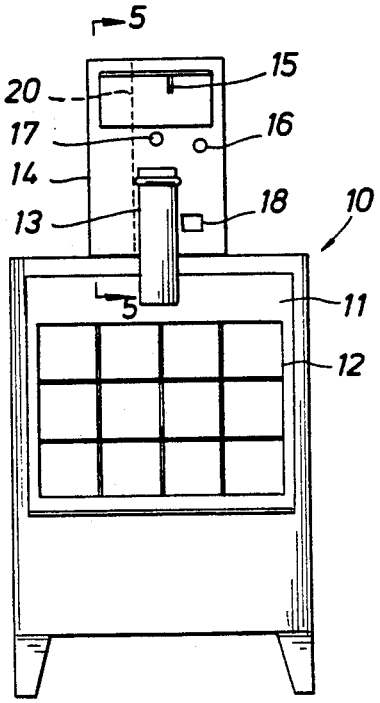
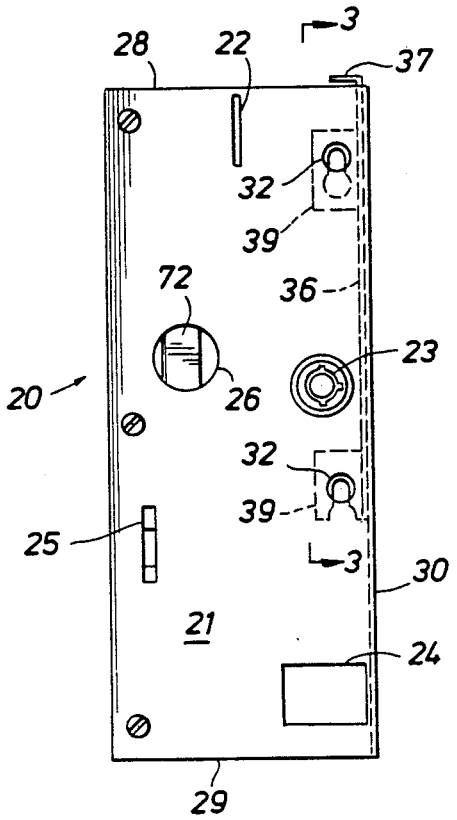
FIG. 2
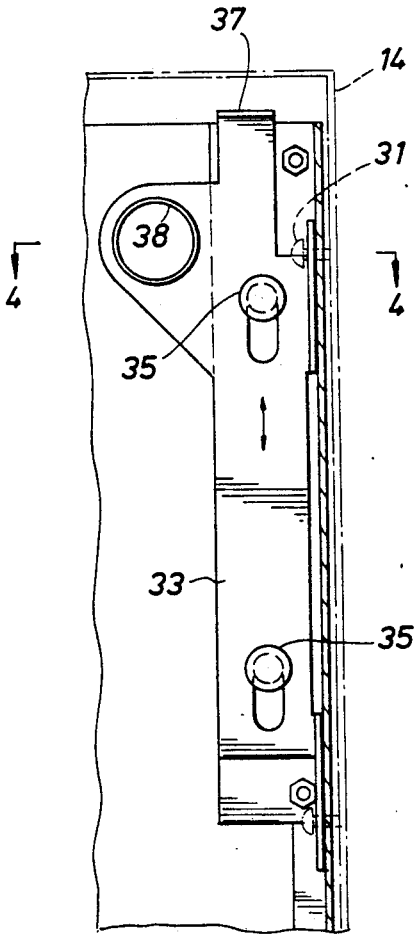
FIG. 3
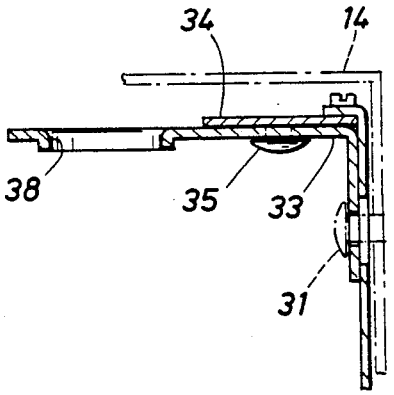
FIG. 4

NEWSPAPER VENDING RACK COIN BOX INCORPORATING A RETROFIT ELECTRONIC COIN MECHANISM

BACKGROUND OF THE DISCLOSURE

This disclosure is directed to a newspaper vending rack coin mechanism, and more particularly a retrofit which is installed therein to enhance the operation of the newspaper vending rack. Newspaper vending racks are well identified in the Knickerbocker patents which bear the following U.S. Pat. Nos. 3,738,466 also 3,882,984 also 3,946,848 also 4,000,799 and 4,037,701.

These set forth newspaper vending rack mechanisms and in particular set forth systems which are able to vend at variable prices. They include features which first and foremost keep the newspaper dry and yet permit its sale through a door on the newspaper rack. In particular, they set forth a mechanism for doing the calculations to specify the deposit of the correct sum of money, and store that money so that the rack can be periodically serviced to add newspapers while also removing the prior accumulation of money.

Ordinarily, a rack will be loaded once, and perhaps twice a day. Some newspapers are able to service their racks in certain locales more than once, but that is the exception. The mode and manner in which the newspapers are actually sold is very frankly a mystery to the proprietor. It is difficult to know whether or not all the papers are sold within ten minutes or ten hours after the rack has been loaded. Moreover, it is difficult to know how rapidly the papers will be sold out whether or not sellout occurs. For instance, the vending rack may sell out quite quickly on weekdays, but may languish on the weekend. Information on the time and frequency of sales would be very useful. That information is not presently available.

This disclosure sets forth a retrofit structure which is adapted to be placed in preexistent newspaper racks and in particular a structure which can be installed in those previously manufactured and sold by the Assignee of the present disclosure, referring to Kaspar Wire Works, Inc. Thousands of racks are distributed around the country. This disclosure is a retrofit which can be installed with great facility in the preexistent newspaper racks so that the data is captured, and that other valuable data is also generated. For instance, this system takes advantage of an electronic circuit which is installed in the vending rack to first measure and count the coins which are inserted into the rack. The device includes a coin inspector which assures that the coins inserted into the newspaper vending machines are legitimate coins. Accordingly, the correct purchase price is counted and determined. After the correct sum of money has been placed in the rack, and the coins are inspected to avoid bogus coins or perhaps coins from another country having little value, the present apparatus releases the rack door through a mechanism which engages the door hook with an electrically controlled closure means. This permits the customer to merely open the door in the conventional fashion. However, while that happens, the present apparatus creates an entry which is the time of day which is stored in computer memory. A specified number of sales can be stored; for instance, the rack might be filled with any number of newspapers up to the maximum which fills the rack, and record each sale occurring at a particular time which is recorded in memory. This data can be stored for a first day, the rack be resupplied the next day, and the data captured for the prior day. The memory is sufficiently large that the time and date of numerous sales can be recorded up to some specified number of sales transactions so that the data for several days can be retrieved at once. The present disclosure further sets forth a means for interrogating memory. A conveniently applied infrared (IR) fitting is included to enable an IR wand to be applied for a remote memory reading device. It is typically hand carried by service personnel and is plugged in so that the IR data transfer occurs. This required a hand shake signal to be transmitted into the system which is recognized, typically a unique code triggering operation of the CPU within the circuit whereupon the data stored in memory is then transmitted out of the circuit. The data which is transferred out includes the time and date of the sales which were held in memory. If desired, the price of each sale can likewise be included, or the price can be known by virtue of the fact that all the newspapers sold through the rack have a specified price, and differ primarily on Sunday. In any case, this data is created daily and held in memory for transfer through the IR wand for transfer to a fixed data processing system for subsequent analysis, etc.

The present apparatus is portable in the sense that it can be placed inside the housing quite easily as a retrofit structure and fit nicely in the housing with such an installation accomplished in just a few seconds. Once installed, electrical power is required. This system utilizes a lever which has a surface deployed in the coin slot. When the lever moves during insertion of a coin, a switch is operated which applies electrical power to the CPU for operation. Power comes from batteries; the batteries have long life because the drain on the batteries is exceedingly small at all times except when actually vending a newspaper. Because it is subject to control of the switch just described, electrical power is consumed only during operation. More accurately, the current flow is so small that battery life is really not impacted and approaches shelf live, that is the life of storage of the batteries. Indeed the quiescent condition is a current drain that is measured in the range of perhaps 100 microamperes or less. Therefore, current drainage is significant only during vending transactions.

The present system also includes an externally exposed switch which a uniquely coded key operates; it is typically located for service in a convenient fashion so that switch operation can unlock the door when moved to one position, set a daily price at another position, set a Sunday paper price at another position, and provide other inputs for operation of the circuitry.

Many objects and advantages of the present apparatus will become more readily apparent on a review of the below written specification which sets out in detail the construction of the preferred embodiment. Moreover, this apparatus has certain advantages which can be only summarized and which will become more fully defined on a review of the specification. Primarily, the present apparatus is a retrofit structure which can be installed in newly made or preexistent newspaper vending racks and which therefore is constructed to fit in the same profile on installation. It incorporates a latch mechanism for easy and quick installation. More will be noted concerning this hereinafter as the retrofit apparatus is described in substantial detail.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a front view of a newspaper vending rack having a closed paper receiving cabinet with a front door and a housing on the top for receiving the retrofit coin mechanism of the present disclosure;

FIG. 2 is a front view of a removeable retrofit coin mechanism in accordance with the present disclosure;

FIG. 3 is a sectional view along the line 3—3 in FIG. 2 showing details of construction of an installation and mounting mechanism for quick installation and release of the retrofit apparatus;

FIG. 4 is a sectional view along the line 4—4 in FIG. 3 showing details of construction of a slide latch mechanism;

DETAILED DESCRIPTION OF THE PREFERRED EMBODIMENT

Figure 5:
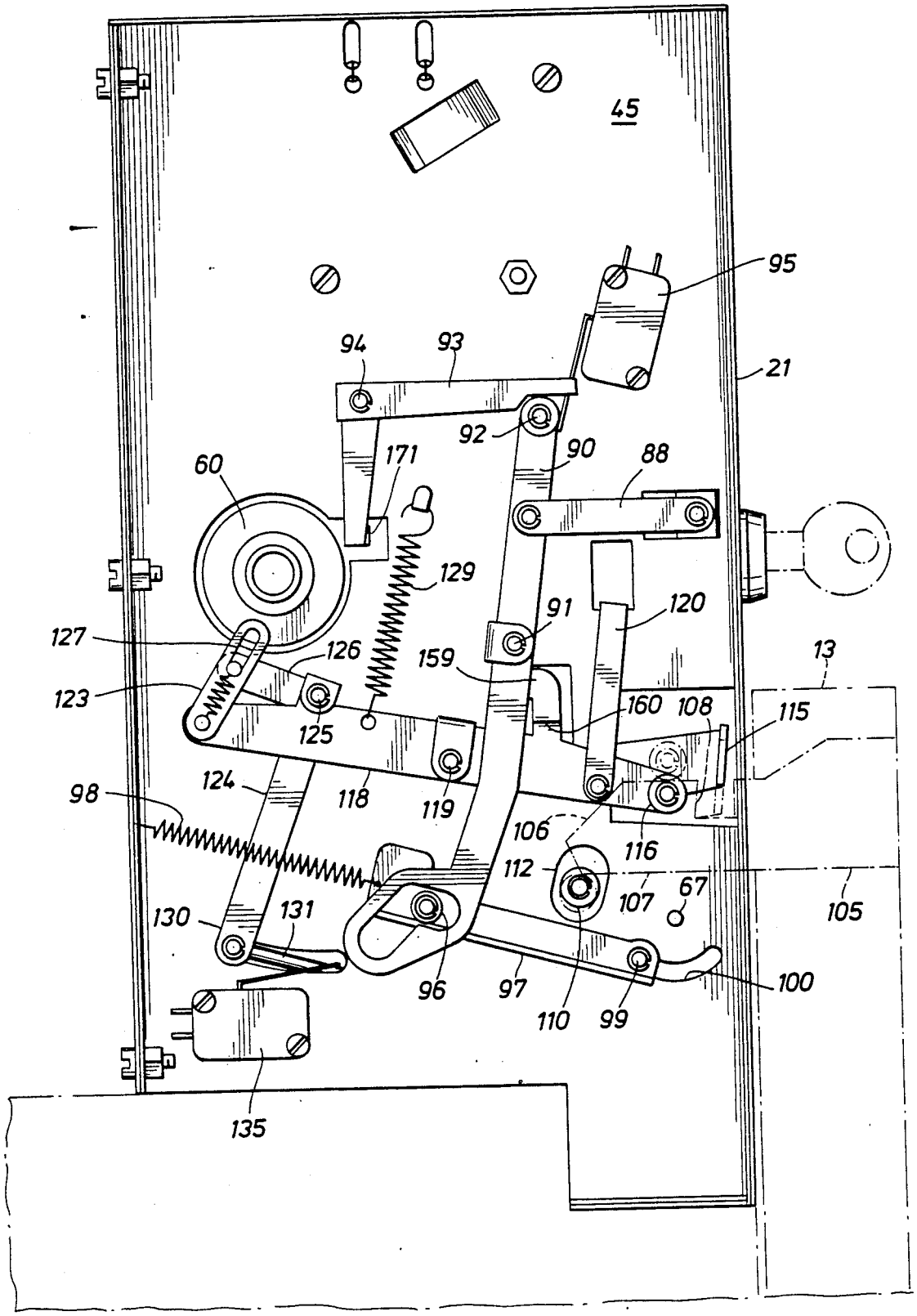
FIG. 5 is a side elevational view taken along the line 5—5 of FIG. 1 of the removable retrofit structure and in particular showing the relationship of the structure to the door hook and the mechanism for latching and holding the door hook and further showing switches which determine opening of the door and the drop of the coins into the vault for storage.

Attention is directed first to FIGS. 1, 2, 3 and 4 considered jointly for a description of the context in which the present apparatus is used. This context incorporates a newspaper vending rack which is identified generally by the numeral 10. It is a closed housing having a hinged front door 11 which opens to vend newspapers. It has a visible window, typically covered with a transparent material, and the window 12 normally has a set of bars across it for security, and a newspaper is often displayed in that area. The door 11 supports a closure bar 13 which extends upwardly. That is positioned in front of or immediately adjacent to a closed housing 14 which is made of heavy duty sheet metal and which is closed on all sides. This housing has several features which need to be noted. Among these features, the housing includes a coin insertion slot 15. In addition to that, there is a key operated switch 16. It is provided so that service personnel can switch the vending machine retrofit apparatus to be described between prices, for example, the Sunday price versus the daily newspaper price. There is additionally a coin return button 17 so that a purchaser can operate that button and thereby obtain return of the coins through the return slot 18. At least to this extent, this is the structure that has existed for several years, and is the structure for which the present disclosure provides a retrofit mechanism.

The retrofit mechanism is identified generally at 20 in FIG. 2 of the drawings which will be described in very general terms hereinafter as the coin mechanism which is an electronically driven retrofit device which can be installed in the hundreds, if not thousands, of preexistent newspaper vending racks of the nature shown at 10 in FIG. 1. The mechanism 20 thus installs inside the housing 14. It does not fill the entire structure and to this end, is shown in dotted line at 20 in FIG. 1. It has a front face 21 which aligns with the coin slot 15, the key operated switch 16, and a return slot 18. The coin reject button 17 also operates with the mechanism 20 as will be described.

Going now to the structure of FIG. 2, it is a generally rectangular structure. It is equipped with the front face 21 as illustrated. It also has a coin slot 22 which aligns with the coin slot 15 when installed. The key switch is illustrated at 23, and the coin return slot 24 is likewise illustrated. An important feature is the narrow rectangular slot at 25 which is provided for the door hook. Above that, there is round hole 26 to enable the coin return push button at 17 to extend through the front panel 21. It operates a bar which is shown in FIG. 2 but which will be detailed substantially hereinafter.

In general terms, the coin mechanism 20 is a rectangular box. Thus it has the described front face 21. It is also provided with a top cover at 28, a separate bottom plate 29 and a side plate 30. The coin mechanism 20 is installed in the larger housing 14 which is shown in FIG. 1. The housing 14 is constructed so that it can be opened to provide access to the vault (inside the housing) where the money is received and stored. The vault must be opened periodically so that the money can be removed and to this end, easy internal access is obtained for the housing 14. As shown in FIG. 4, the external housing 14 is also illustrated in phantom line so that the installation mechanism can be more readily understood. Installation is accomplished in part through the use of studs with heads identified in FIG. 4 at 31. Preferably, there are two which are located on the back side of the front of the housing 14 as illustrated in FIGS. 3 and 4. The rectangular structure 20 thus includes the round openings at 32 which match the location of the studs 31. In the preferred embodiment two or more are included. The heads are inserted through the openings 32 so that they are fully on the interior. A slide bar 33 is mounted on a guide plate 34 (FIG. 4) for controlled vertical reciprocating movement. The guide plate 34 is attached to the front face 21 of the coin mechanism. The plate 34, being relatively fixed, and holding the two guide pins 35 in fixed location, serves as a guide for the slide bar 33. The slide bar 33 has a pair of finger engaged means for easy manipulation including the bent tab 37 (FIG. 2) and the finger hole 38. These can be engaged so that the latching motion can be obtained. The bar 33 carries on it at right angles a pair of spaced locking plates 39 which are able to slide down over the necks of the studs 31. In the up position they provide a diameter sufficiently large to pass over the head of the studs 31; latching is thus assured when the lock members 39 move to the position shown in FIG. 2, and also shown in side view at FIG. 3.

COIN MECHANISM STRUCTURE

Figure 7:
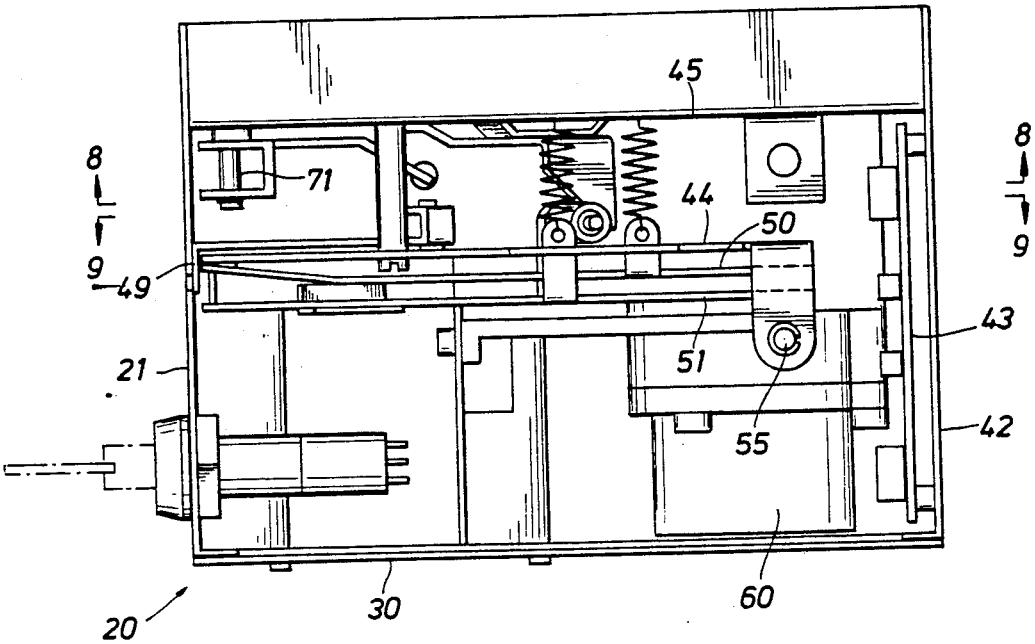
FIG. 7 is a plan view looking down into the interior of the retrofit apparatus and showing details of construction of the coin chute.
Figure 9:
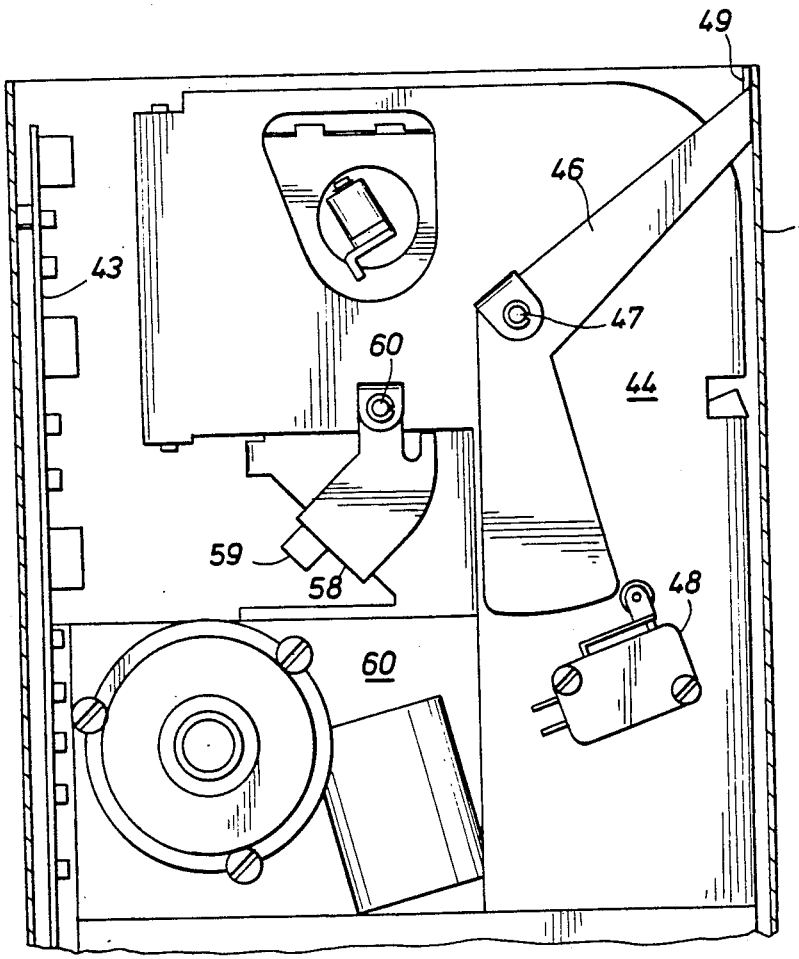
FIG. 9 is a view of the coin chute and a lever for initiating operation on the insertion of a coin.
Figure 8:
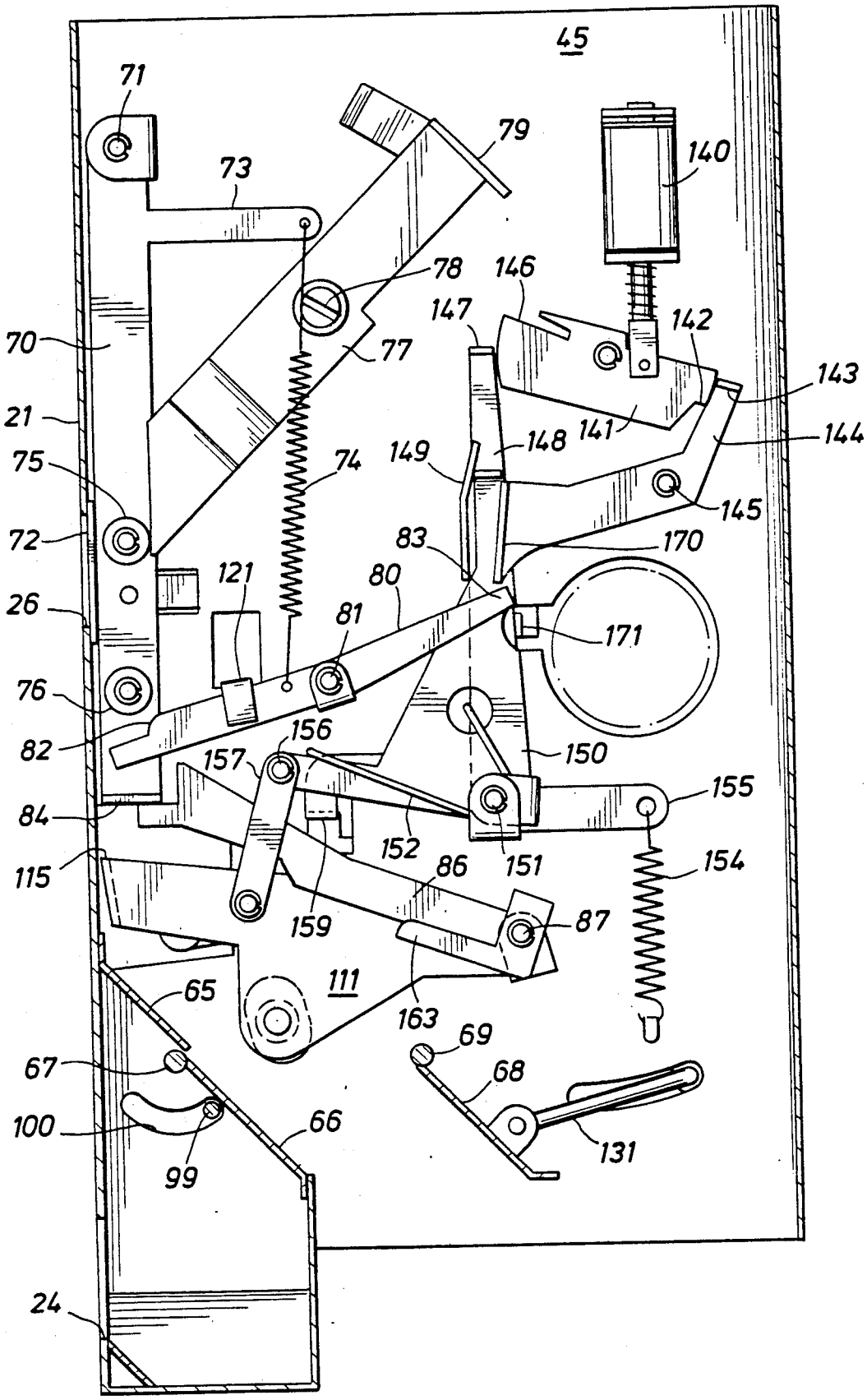
FIG. 8 is a side view of the same plate shown in FIG. 5 but from the opposite side thereof to show the mechanism in greater detail and illustrating the linkage which is appropriate for operation.

Attention is momentarily directed to FIGS. 7 and 9 for a general overview of the layout of the coin mechanism 20. Briefly, the plan view of FIG. 7 looks down in the interior of the equipment. It is box like behind the front panel 21 and the sidewall 30. There is a back wall 42 which supports a printed circuit board (PCB) 43. The rectangular construction includes a coin chute support wall 44; that is parallel to the sidewall 30. It supports the coin chute as will be detailed. In addition to that, there is another plate or sidewall 45 and it serves as a support member for other components as illustrated in FIGS. 5 and 8. This will be detailed later.

Important features of the present apparatus primarily trace from operation of the wake-up switch as will be detailed regarding FIG. 9. Briefly, FIG. 9 shows a lever 46 supported on a pivot point 47 and having an arm for operation of a wake-up switch 48. The switch 48 controls operation of the electronic circuitry; it is normally off and stays off so that battery current drainage is nil. In fact, the battery life is approximately that of the shelf life of the batteries. There is an extremely small current drain for operating the clock and holding the memory data, but this is typically less than 100 microamperes and is therefore so small that it does not reduce the life of the batteries. The batteries are protected against excessive drainage by the wake-up switch 48. The switch 48 is operated when a coin is inserted through the coin slot. The switch is operated when the coin strikes a transverse tab 49, the tab 49 being located just behind the coin slot 22. The lever 46 is weighted so that it hangs in the position illustrated in FIG. 9. It is upset on coin insertion and initiates operation. It is not permitted to swing beyond the location shown in FIG. 9. Thus, coin insertion provides an upset motion which is converted into operation of the switch 48.

The coin is directed through the coin chute. The coin chute is defined by a pair of pivotally mounted plates 50 and 51 in FIG. 7. The coin travels downwardly by gravity between the plates. It is supported on an inclined ramp 52 (FIG. 6) and passes below similar inclined ramps 53 and 54 shown in FIG. 6. The coin is thus guided above the ramp 52 and below the ramps 53 and 54 and is captured between the plates 50 and 51 (FIG. 7). The ramps 53 and 54 are exclusively between the two plates 50 and 51, and in FIG. 6, the marginal edges of these two ramps are shown so that the ramps are spot welded in location of the plate 51. Moreover, the ramp 52 is different in that it is supported on the plate 44. Thus, the plates 50 and 51 can swing away from the ramp 52. This is useful in coin rejection. That is, the ramp 52 is a flanged member spot welded to the plate 44, see FIG. 6. The ramp serves as a guide so long as it is below the plates 50 and 51. However, the plates 50 and 51 have protruding mounting tabs at the back end which are supported on an upstanding shaft 55; they therefore pivot, and rotate about the shaft 55. As viewed in FIG. 7, when they pivot, they move from the registered position above the ramp 52 so that coins can drop away from the plates 50 and 51. Coins then drop directly (see FIG. 6) downwardly to rest at the escrow area 56 which is defined by the V-shaped doors therebelow, and for subsequent disposition as will be explained.

The ramp 52 guides any coin between the plates 50 and 51. At that juncture the coin is free to fall downwardly and away from the plates 50 and 51. The plates 50 and 51 drop the coin downwardly past a vertical tab 57 between the two plates. The tab 57 prevents escape of the coin if it rolls too far to the right in FIG. 6. The coin is directed downwardly and strikes a transverse tab 58. The tab 58 is provided with added weight at 59. Looking jointly at FIGS. 6 and 9 of the drawings, the tab 58 is pivotally mounted at 60, and is able to swing away to permit the coin to pass, thus causing the coin to drop directly downwardly. The coin drops downwardly into a coin slot for entry into a coin inspection apparatus 60. The slot for entry of the coin is located immediately below the tab 58; the slot is aligned with the plates 50 and 51 so that the slot is otherwise located for receipt of the coin so long as the plates 50 and 51 are parallel to the plate 44 (see FIG. 7).

The coin inspection apparatus 60 is a bought item which measures the coin, that is, tests the coin by measurements to determine whether of not it is bogus, and provides a signal if the coin is bogus. In any event, the coin is discharged from the bottom side of the coin inspection apparatus 60. Recall that the coin was traveling parallel to the plate 44 when it was above the ramp 52. The plate 44 is also shown in the lower portions of FIG. 6 so that the coin has traveled in substantially the same vertical plane, and the coin then drops out of the mechanism 60 adjacent to the plate 44 and rolls on the sloping plate 62. The plate 62 is fixed to the plate 44, and directs the coin rolling downwardly into the escrow location 56.

To summarize to this juncture, there are two routes of coins to the escrow location 56. One route is through the coin inspection apparatus 60. Coins emerging from that device are dropped so that they travel above the plate 62 to the escrow location. The alternate path is obtained when the coin chute plates 50 and 51 are pivotally moved. When this occurs, they move away from the ramp 52 and thereby position themselves so that any coins will drop through the plates 50 and 51 and will fall downwardly adjacent to the plate 44 shown in FIG. 6 and fall to the escrow location.

Figure 6:
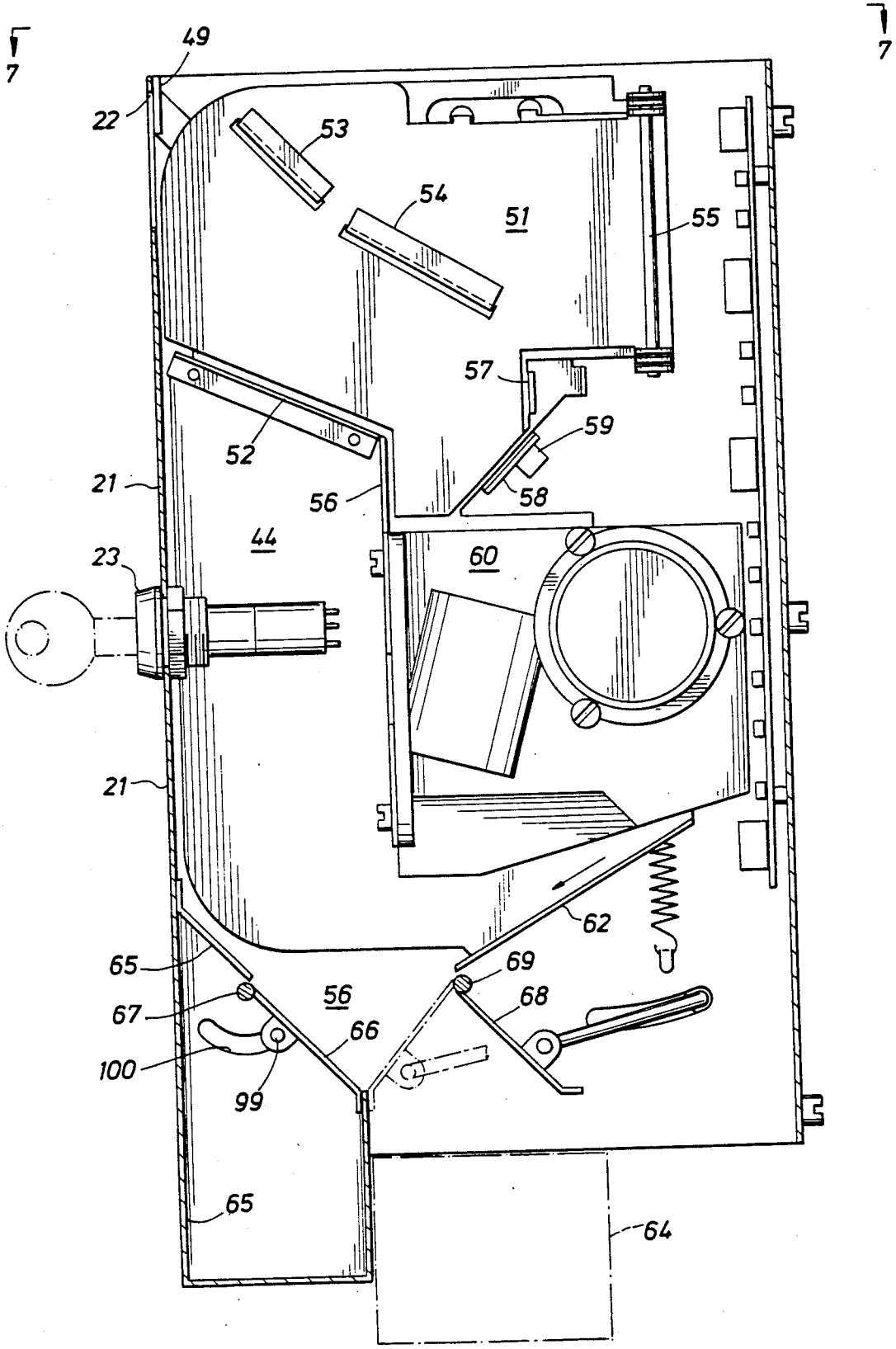
FIG. 6 is a side elevational view showing a coin chute mechanism within the structure which directs the coins to an inspection apparatus and which ultimately transfers the coins to an escrow location above a pair of pivoted doors.

The escrow location extends the full width of the coin mechanism 20. It is a V-shaped trap which is formed by opposing trap doors. The doors or gates are shown in FIGS. 6 and 8. The numeral 64 indicates in dotted line a vault which is part of the housing 14 shown in FIG. 1. It is not a part of the retrofit coin mechanism; the coin mechanism does however include a coin return box 65 which opens through the coin return slot 24 on the front face 21 (FIG. 2). Thus when a coin (or several coins) is located in escrow, the disposition of the coin depends on whether or not the coins are measured and deemed valid, represent the correct amount for the sale, and the purchaser has not otherwise operated the coin return by button 17. The two doors are thus shown in FIGS. 6 and 8. Coins falling to the escrow position are guided by an angled plate 65 (FIG. 6), and the door 66 is immediately therebelow mounted for rotation on a hinge pin 67. A downwardly protruding tab and linkage to be described rotates the door 66; it is biased to the closed position or the full line position in FIGS. 6 and 8. This door will be described as the return door, meaning that it is opened so that coins are directed to the coin return slot 24. In a similar fashion, there is a similar door 68 which is mounted on a hinge pin 69. In the dotted line position shown in FIG. 6, the door 68 closes and assists the door 66 to form the V-shaped trap which extends substantially the full width of the equipment and thus defines the escrow location. The two doors operated in similar fashion with similar connective tabs and linkages as will be described. As shown in FIG. 6, when the door 68 is opened to the full line position, the coins fall into the vault 64 and are stored for subsequent retrieval. When this occurs, the sale has been consummated.

COIN REJECTION AND ESCROW TRANSFER

Going to FIG. 8 of the drawings, a coin rejection bar 70 is pivotally mounted on a shaft 71 which is secured to the mounting plate 45. The plate 45 is shown in FIGS. 5 and 8, the two views showing opposite sides of this mounting plate. Wobble by the coin rejection bar 70 is prevented by folding it into a U-shaped pair of tabs on the shaft 71 as shown in the plan view of FIG. 7. The opening 26 in the face plate 21 is illustrated in FIG. 8; the coin reject bar 70 supports a tab 72 which can be viewed in the opening 26, see FIG. 2. The components involved with the coin reject bar 70 in FIG. 8 include the lateral arm 73 which connects with a coil spring 74, and that spring connects with other components described later. The coin reject bar 70 supports spaced rollers 75 and 76. The roller 75 contacts the end of a lever 77 which rotates about a pivot at 78 and which supports a tab 79 at the end for interaction as will be described.

The roller 76 works against a pivotally mounted lever 80 which rotates about the pivot at 81 with contact made at the curving shoulder 82. The tip 83 of the lever cooperates with different equipment to be described in detail hereinafter.

The coin reject bar is pushed through the opening in the front face plate 21 and rotates counterclockwise as viewed in FIG. 8. The lower end is therefore rotated but is limited in rotation by interaction of an affixed lower tab 84 extending at right angles which engages a lock lever 86. The lever 86 has a notch formed in its free end to engage the tab 84. The lock lever 86 rotates about the pivot point 87, and that operation will be described in detail hereinafter. The reject bar 70 supports a push bar 88 which is on the opposite side of the plate 45 and is therefore shown in FIG. 5 of the drawings. The push bar 88 is connected parallel to the plate 45. The push bar connects with a crank 90 which is mounted on a pivot at 91. This crank supports a roller 92 at its uppermost end. The roller 92 engages an L-shaped bell crank 93 and causes it to rotate about the pivot 94. More importantly, it is positioned to contact and operate an actuator for a switch 95. The switch senses movement of the coin reject bar 70 through the coupling just described. The crank 90 at the lower end supports the L-shaped internal groove. That groove engages a roller 96 mounted on a push bar 97 which is pulled by a return spring 98. Against the force of the spring, the push bar 97 engages a link pin 99 which extends through the mounting plate 45 and moves in an arc guided by the groove 100. This groove 100 is shown in FIGS. 5, 6 and 8, and the link pin 99 is also in these views where it is connected to a tab affixed to the lower side of the trap door 66. The door is therefore opened and closed. This door is involved in the rejection of coins.

One simple sequence of operation of the coin reject mechanism at the urging of the user or customer should be considered. If the customer is required to deposit multiple coins and discovers that they do not have the right coins, then the coins which have been deposited at escrow 56 can be retrieved. This is accomplished by pressing in on the push button 17 which initiates the coin return mechanism. In turn, that presses against the tab 72 showing in FIG. 2 of the drawings. Going now to FIG. 8 and then to FIG. 5, movement of the push button causes the coin reject bar 70 to rotate counterclockwise. It accomplishes several things in its movement, but in particular the movement is coupled through the mounting plate 45 to the push bar 88 in FIG. 5 and causes the crank 90 to rotate in a counterclockwise direction. That moves the L-shaped opening at the lower end and causes the push bar 97 to move which causes rotation of the door 66, and thereby dumps the coins into the coin return slot (see FIGS. 2, 6 and 8).

Going back now to FIG. 5 of the drawings, the description will set forth the means and mechanism by which the door hook is latched and held. The dotted line of FIG. 5 indicates the upstanding bar 13 affixed to the door, and the door hook is identified in phantom line by the numeral 105. The door hook particularly includes a forward sloping surface 106, a straight lower edge 107, and a notch 108. As the door hook enters, it passes through a relatively narrow slot 25 in the face 21, the slot 25 being shown in FIG. 2 of the drawings. The lower edge 107 rides over a roller 110, the roller 110 being affixed to a lock arm 111 on the opposite side of the plate 45. The lock arm is therefore shown in FIG. 8 where it pivots about the pivot 87 which is shared with the lock bar 86. When the door hook contacts the roller 110, it is forced downwardly and rotates the lock arm 111 counterclockwise as viewed in FIG. 8 of the drawings. There is a large window 112 cut in the plate 45 to permit the roller to extend through the plate so that it is on the FIG. 8 side but its operation occurs on the FIG. 5 side of the plate 45. When this operates to rotate the lock arm 111 downwardly, that carries with it the hook 115. The hook 115 extends into the locus of the door hook and thus falls into the notch 108. It however is mounted on the far side of the plate 45 from that visible in FIG. 5; in FIG. 8, the lock arm 111 again supports the hook 115. To this juncture, it should be recalled that the lock arm 111 supports both the roller 110 and the hook tab 115 and they move jointly as a unit rotating about the pivot 87.

Going back to FIG. 5 of the drawings, the door hook engages a roller 116, and that roller is located at the extreme end of a pivoted bar 118. This bar pivots about the pivot 119. It transfers motions in several directions through other links. In FIG. 5, the bar 118 is connected with an upstanding link 120 which extends upwardly and which has an upper end appended for coupling motion through the mounting plate 45 and that reaches through the plate 45 and hooks around the pivoted lever 80. This lever is free to rotate, but it is constrained by the hook or tab 121 which prevents rotation in one direction. The spring 74 thus rotates the lever clockwise in FIG. 8, but rotation is limited by the tab 121 just mentioned and that in turn is connected to the bar 118.

The bar 118 extends further to the rear of the cabinet and there connects with a pivoted link 123, and that link in turn connects to an L-shaped crank 124. The crank 124 is mounted on a pivot 125. It has a short arm 126 engaged by a lost motion linkage (pin and slot) 127, and that is connected with the link 123. The crank 124 is pivotally mounted at 125. The pivot 125 serves as a stop for the arm 118. It is pulled upwardly in clockwise rotation by a return spring 129, but it is limited in travel by the aforementioned pivot 125.

Counterclockwise rotation of the bar 118 around the pivot 119 against the urging of the spring 129 also produces counterclockwise rotation of the crank 124. The crank 124 has the lower extreme tip 130 connected with a push rod 131, the rod passing through the mounting plate 45, and the push rod 131 connects with the swinging door shown in FIG. 8. That is, the door 68 which is pivotally mounted on the hinge pin 69 is shown in the full line position of FIG. 8 which is the open position. Most of the time, it is closed but is illustrated in the solid line position open in FIG. 8. Movement of this door drops money from the escrow 56 into the vault 64. This motion is coupled through the push rod 131 to the swinging door 68.

Movement of this arm and hence opening of the door 68 to the vault is signalled to a switch 135 where a means detecting operation and therefore is able to form a signal transferred elsewhere for reasons to be described.

Consider operation of the two switches 95 and 135 shown in FIG. 5 of the drawings. When the coin reject bar 70 is operated as shown in FIG. 8, it is forced to rotate counterclockwise by a coin reject motion. This couples motion from the reject bar 70 wherein the motion is transferred through the plate 45 to the push bar 88 shown in FIG. 5 of the drawings. That is cause to actuate the crank 90 and it rotates in a counterclockwise direction. At the upper end of this lever, a signal is formed for the switch 95 which indicates that a coin reject operation has occurred. In other words, the signal is provided to the circuitry. At the lower end of the crank 90, rotation is accomplished with the L-shaped groove at the end of the crank 90, the push bar 97 working against the return spring 98, and the link pin 99 is moved, thereby guiding along the arc 100 and rotating the door 66 open. When it opens, it dumps money from escrow into the coin return box. When this later occurs, a signal is provided by the switch 135 indicative of door opening.

Attention is now directed to additional components of the system shown in FIG. 8 of the drawings. There, a solenoid 140 pulls upwardly when electrical power is applied and rotates a lever 141. The lever 141 includes a shoulder 142 which selectively engages a tab 143 below the shoulder. Tab 143 is affixed to a bent arm 144 mounted on a pivot 145 and rotatable through a few degrees of rotation. The lever 141 additionally includes another top located shoulder at 146, and that is located to engage the hook tab 147 immediately adjacent thereto. The tab 147 is on the long arm 148 which is part of another structure to be detailed. The arm 148 supports a pair of confining tabs 149 which control the relationship of the arm 144 and the arm 148.

The arm 148 is part of a T-bar 150 which is a unitary structure which is preferably formed of two or more pieces of material. The T-bar rotates on a pivot 151, and torsion spring 152 creates a torque keeping the two separate pieces of the T-bar together so it forms a single unit. It has the appearance of an inverted T as shown in FIG. 8, and at one end, a coil spring 154 is connected to an appended arm 155. The opposite extremity is pivotally connected at 156 to a link bar 157 and that is connected to the lock arm 111 previously mentioned so that the two must rotate in unison. The T-bar supports a downwardly protruding tab 159 which is folded to extend through the mounting plate 45 and to engage a cooperative tab 160, see FIG. 5. The tabs 159 and 160 shake hands, so to speak, through an opening cut in the mounting plate 45. Recall the lever 86 which is in the position to lock the coin reject bar 70; it is supported on the pivot 87 and is integrally constructed with the protruding arm 163.

Other interlocks shown in FIG. 8 of the drawings need to be noted. The lever 80 has a tip 83 which is prevented from rotating excessively upwardly by the upstanding tab 170. In addition to that, the tab 171 (FIG. 8) is supported on the arm of the L-shaped bell crank 93 rotating about the pivot 94, see FIG. 5.

LATCH HOOK ENGAGEMENT/DISENGAGEMENT FOR VENDING A NEWSPAPER

The ordinary condition of the door hook 105 is the dotted line position shown in FIG. 5 of the drawings where the door hook is fully held against opening. In this condition, the door hook has pressed the roller 110 downwardly to the dotted line position seen in the drawings. When that moves down, it connects to the lock arm 111 and pulls the hook 115 downwardly into the door hook notch 108 previously mentioned and holds the door hook fast. Thus, it is not possible to strong arm the door open. In operation, the roller 116 moves independently of the roller 110. So to speak, the two rollers catch on the top and bottom edges respectively of the door hook. The roller at the top is forced upwardly, rotating the bar 118 in a counterclockwise rotation and setting the equipment to hold the door hook and provide position indication of its engagement.

The door must be unlatched to vend the paper. This is accomplished substantially in the fashion set forth in the Knickerbocker U.S. Pat. No. 4,037,701 wherein the roller 116 is moved upwardly. Release for opening to vend a newspaper is triggered by determining that the correct amount of money has been paid, whereupon a sales transaction is permitted to occur. The door is released by disengaging the door hook and the door hook can then be retracted from the dotted line position of FIG. 5 to be fully outside the coin mechanism 20. Simultaneously, the rollers 110 and 116 are positioned for return of the door hook when it is slammed shut after selling the newspaper. Moreover, this sequence is involved with operation of the solenoid 140 which make a short stroke upwardly to achieve opening, and that motion in turn is coupled to the arms 144 and 148 which are initiated in operation by the solenoid 140.

CIRCUIT DESCRIPTION

Figure 10:
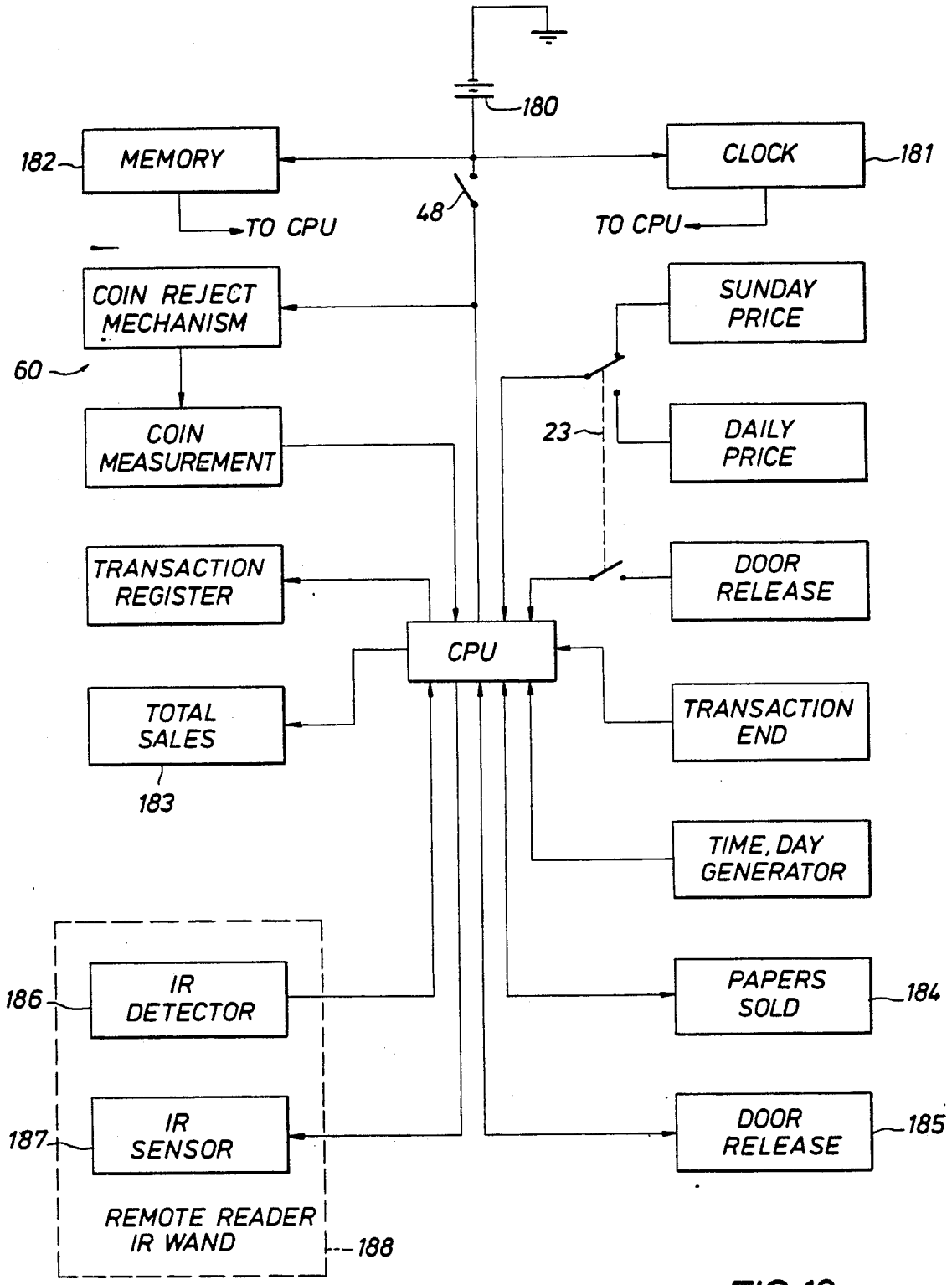
FIG. 10 is a block diagram schematic of the electronic system included in the retrofit mechanism of the present disclosure.

Of particular interest in operation of the present apparatus are the detector switches 95 and 135 shown in FIG. 5. Briefly, the switch 95 provides a signal that the door has been opened which the switch 135 provides a signal that the escrow 56 has been emptied by the open door into the vault 64. These are particularly useful in providing input signals to the circuitry for the present apparatus shown in FIG. 10 of the drawings. The numeral 180 identifies a power source which is typically four AA batteries in series to furnish 6 volts, but it will work even as the voltage sags to a very low value. It provides microampere current flow to an integrated circuit which includes a clock 181 and memory 182. These operate in continuous fashion from the time of installation. The clock is adjusted to provide the correct time typically military time, and date.

The switch 48, when it operates, provides the circuitry with electrical power. At this time, the current from the voltage source 80 is only a few milliamperes. A coin reject mechanism 60 is included as previously mentioned. The coin reject mechanism tests and determines whether or not the coin is bogus. Also, it determines whether the coin is worth five cents, ten cents, etc. and that forms an output to a transaction register. The transaction register totals up the sum that has been input in this particular transaction such as thirty-five cents to purchase a daily newspaper. The transaction register may have to total one dollar and twenty-five cents for a Sunday paper by way of contrast. In any event, as the coin falls through the means 60 and is measured because it is valid, the coin reject mechanism 60 passes the coins, transfers them to the escrow location discussed, provides a signal which is indicative of the monetary value and that is input to the transaction register. The transaction register stores the total of the transaction for the moment.

Recall that the equipment shows a switch 23 which is operated by service personnel. The switch 23 is identified in FIG. 10 and selects Sunday or daily prices. These prices are input at two or more registers and input to the CPU. The switch 23 also operates a door release which overrides and causes opening of the door, and that in turn couples through the CPU. The CPU is connected with the clock and memory. The CPU in conjunction with the clock forms time and date, and that data is entered into the memory. When a particular transaction occurs, the time and date is recorded in memory and the relative value of that particular sale is also recorded. This repeats for each sale.

When the vending rack is stocked with a supply of papers, assume that a fixed number of fifty papers is installed while the memory is preferably reset. There is a total sales register 183. There is a paper sales counter 184. As each transaction occurs, incremental inputs to the total sales register 183 and the paper sold register 184 are made. These are advanced with each transaction. As noted above, the time and date are input to the memory 182 and the data is stored. When a purchase occurs, or alternately when service personnel operate the switch 23 with an appropriate key mechanism, the door is opened and that is accomplished by a door release mechanism 185. On each release of the door, and as a result of the linkage which is shown in FIG. 5 of the drawings, appropriate signals are formed by the switches 95 and 135 which are forwarded to the CPU to indicate that the transaction has ended. In other words, the transaction is over because the door has been opened as sensed by the switches shown in FIG. 5 and the money in escrow has been dumped into the vault. This end of transaction signal is conveyed to the CPU which causes the CPU to shut down. All of the circuitry shown in FIG. 10 then becomes dormant, and is no longer operative save and except the continual running of the clock 181 and maintenance of the data which is stored in the memory 182. When this occurs, the system is dormant and the current drain is nil or practically so.

Output from the present system is obtained through a remote reader IR wand. A small IR detector 186 in conjunction with an IR sensor 187 are located in a rather small receptacle, typically a small port which is internally sealed with a protective lens. A well known IR wand for a portable reader is inserted to read the stored data. This is inserted so that the reader can transmit and receive IR information for interrogation of the data in memory. Thus, the numeral 188 identifies the port, and the wand is engaged to obtain the data from memory. This data is transferred out of the system through the infrared coupling. The data transaction normally occurs by transmitting through the detector 186 a coded symbol such as a password that the CPU recognizes and which causes the CPU to instruct the memory 182 to unload through the IR sensor 187. This data is organized in a suitable format in the memory 182 and is transmitted out of the sensor 187.

Data is captured over a period of time such as one week. It is retrieved periodically and is in the form of line entries listing the time and date of each transaction. The price can be optionally included. This data is very important to knowing and understand the stocking of the newspaper vending rack. If for instance it sells out on certain days, this information can be determined and the stocking in the newspaper vending machine can be increased. By contrast, if someone periodically steals all the papers that remain, the time can be fairly well identified because it will be the last transaction which occurs in the machine. All of this information is useful to providing an optimum number of newspapers in the machine at different times and dates.

While the foregoing is directed to the preferred embodiment, the scope is determined by the claims which follow.

What is claimed is:

1. An improved newspaper vending rack having a coin box installed with a rack which rack and coin box, after coin box installation, includes:

(a) a closed paper receiving cabinet;

(b) a hinged door on said cabinet;

(c) a protruding door hook for closing said door;

(d) a closed coin receiving housing supported by said cabinet;

(e) door hook closure means cooperatively latching said door hook on closure thereof; and (f) a retrofit, electrically powered coin measuring means mountable in said housing and wherein said coin measuring means operatively connects to said closure means releasable engaging said door hook to permit opening of said door and wherein said coin measuring means further includes:

(1) a coin receiving slot having the form of a slot enabling coin insertion;

(2) means located to detect a coin placed through said slot, and said detector means includes:

(i) lever means mounted to obstruct entry of a coin into said slot and wherein said lever means is movable for coin entry; and (ii) switch means connected to said lever means for switching on said coin measuring means for operation;

(3) an electrical power supply; and (4) wherein said coin detector means momentarily connects said power supply to said coin measuring means to provide power thereto for operation for an interval and said measuring means operates and thereafter shuts off electrical power.

2. The apparatus of claim 1 wherein said lever means is mounted on a pivot means to position a transverse surface just inside said coin slot, and said lever means includes an arm striking said switch means to apply power to said coin measuring means.

3. The apparatus of claim 1 wherein said coin measuring means includes:

(a) a coin chute defined by a pair of spaced of parallel walls;

(b) a transverse partition confining a coin between said parallel walls;

(c) coin inspecting means connected with said coin chute wherein said coin chute extends in a downward direction so that gravity moves a coin along said coin chute to said coin inspection means;

(d) an outlet from said coin inspection means delivering said coin to means for holding said coin in escrow;

(e) means for control of coins in escrow for selectively opening and closing to deliver coins either into a vault means or to a coin return slot.

4. The apparatus of claim 3 wherein said last named means includes first and second pivotally mounted doors which close to define a V-shape trough for holding coins in escrow, and further includes means for selectively opening and closing said doors.

5. The apparatus of claim 4 including means triggered by operation of said door hook for opening and then closing of said door to cause coins to be moved from said though.

6. The apparatus of claim 1 wherein said door hook closure means includes a lower side roller and an upper side lock wherein said door hook has lower and upper sides engaging said roller and lock for locking movement of said door hook.

7. The apparatus of claim 1 including an enclosure for said coin measuring means, and said enclosure has means for mounting within said housing and including a slidable lock moveable between and locking and releasing positions.

8. A coin responsive newspaper vending rack wherein the rack includes:

(a) a closed paper receiving cabinet;

(b) a hinged door on said cabinet;

(c) a protruding door hook on said door;

(d) a closed coin receiving housing supported by said cabinet;

(e) door hook closure means cooperatively latching said door on closure thereof; and (f) coin measuring means having:

(1) coin insertion slot for coins up to a selected size;

(2) downwardly extending coin chute means;

(3) coin escrow means below said chute means to hold coins in escrow;

(4) pivotally mounted door means below escrowed coins for return of coins to an exposed chamber for easy retrieval;

(5) electrically powered, pivotally mounted second door means below escrowed coins for opening to drop escrowed coins into a vault means;

(6) means located to detect a coin placed through said slot, and said detector means includes;

(i) lever means mounted to obstruct entry of a coin into said slot and wherein said lever means is movable for coin entry; and (ii) switch means connected to said lever means for switching on said coin measuring means for operation;

(7) an electrical power supply; and (8) wherein said coin detector means momentarily connects said power supply to said coin measuring means to provide power thereto for operation for an interval and said measuring means operates and thereafter shuts off electrical power.

9. The apparatus of claim 8 wherein said door means and second door means jointly form a coin receiving trough defined by a pair of spaced end walls, and including means biasing said door means into the trough defining position.

10. The apparatus of claim 8 wherein said coin measuring means further has:

(a) means measuring coins for bogus coin rejection;

(b) means totalling the value of two or more coins until the value equals that of a newspaper in said cabinet;

(c) means for inputting alternate newspaper values to said coin measuring means; and (d) data storage means for receiving and holding data relating to newspaper sales.

11. The apparatus of claim 8 wherein said coin measuring means further include:

(a) register means for storing the time and date of a newspaper vending transaction;

(b) register means for storing the cost of a daily newspaper;

(c) register means for storing the cost of a Sunday newspaper; and (d) register means for storing total newspaper sales revenue.

12. The apparatus of claim 8 wherein said coin measuring means further includes:

(a) switch means connected with an electrical power source;

(b) a CPU connected with said switch means for receiving electrical power for operation thereof when said switch means is operated; and (c) memory means connected to said CPU for storing data regarding newspaper vending sales transactions.

13. The apparatus of claim 8 wherein said coin measuring means further includes:

(a) memory means for storing therein data regarding newspaper vending sales transactions; and (b) a data connection means enabling transferring of data out of said memory means to a remote device so that newspaper vending sales transactions data can be transferred to such a remote device.

* * * * *